US007828380B2

(12) United States Patent
Olarte

(10) Patent No.: US 7,828,380 B2
(45) Date of Patent: Nov. 9, 2010

(54) PEW STYLE SEATING ASSEMBLY

(75) Inventor: Alvaro Mauricio Olarte, Aventura, FL (US)

(73) Assignee: Series International, LLC, Miami, FL (US)

( * ) Notice: Subject to any disclaimer, the term of this patent is extended or adjusted under 35 U.S.C. 154(b) by 694 days.

(21) Appl. No.: 11/538,917

(22) Filed: Oct. 5, 2006

(65) Prior Publication Data

US 2007/0138849 A1 Jun. 21, 2007

Related U.S. Application Data

(63) Continuation-in-part of application No. 10/991,847, filed on Nov. 18, 2004, now Pat. No. 7,478,876, and a continuation-in-part of application No. 10/756,743, filed on Jan. 13, 2004, now Pat. No. 7,204,553.

(51) Int. Cl.
*A47C 15/00* (2006.01)
*A47C 1/00* (2006.01)

(52) U.S. Cl. ..... 297/248; 297/331

(58) Field of Classification Search ..... 297/335, 297/248, 257, 331

See application file for complete search history.

(56) References Cited

U.S. PATENT DOCUMENTS

| | | | | |
|---|---|---|---|---|
| 1,662,378 | A | 3/1928 | Duke | 297/257 |
| 3,098,677 | A | 7/1963 | Williams | 16/298 |
| 3,300,246 | A | 1/1967 | Bouche | 297/232 |
| 3,589,762 | A | 6/1971 | Henrikson | 297/324 |
| D221,642 | S | 8/1971 | Bayes | D6/371 |
| 3,641,614 | A | 2/1972 | Newsome | 15/250.32 |
| 3,762,765 | A | 10/1973 | Piretti | 297/162 |
| 3,785,600 | A | 1/1974 | Padovano | 248/188.1 |
| 3,796,459 | A | 3/1974 | Weber | 297/60 |
| 3,850,476 | A | 11/1974 | Day | 297/335 |
| 4,179,158 | A * | 12/1979 | Flaum et al. | 297/440.17 |
| 4,297,763 | A | 11/1981 | Lautenschläger | 16/164 |
| 4,330,898 | A | 5/1982 | Thompson et al. | 15/250.32 |
| 4,850,159 | A | 7/1989 | Conner | 52/9 |
| 4,865,377 | A | 9/1989 | Musser et al. | 296/65.1 |
| 4,989,915 | A | 2/1991 | Hansal | 297/378 |
| 5,033,792 | A | 7/1991 | Kanazawa | 297/417 |
| 5,282,662 | A | 2/1994 | Bolsworth et al. | 296/65.1 |

(Continued)

OTHER PUBLICATIONS

Letter received from Vedder Price P.C. (dated May 4, 2010); 2 pages.

(Continued)

*Primary Examiner*—Milton Nelson, Jr.
(74) *Attorney, Agent, or Firm*—St. Onge Steward Johnston & Reens LLC

(57) ABSTRACT

A pew style seating assembly includes a plurality of seat members, each of which is pivotable, independently from all others of the plurality of seat members, between an occupied position and an unoccupied position. Each seat member, when in the occupied position, defines a seating area above a top surface thereof, with the seating areas defined by the plurality of seat members defining a continuous and uninterrupted pew seating area spanning the plurality of seat members. The seating assembly further includes a single, continuous seat back attached to each of the seat support members and spanning the entire pew seating area, such that the plurality of seat members are associated with the single, continuous seat back.

22 Claims, 12 Drawing Sheets

U.S. PATENT DOCUMENTS

| | | | | |
|---|---|---|---|---|
| 5,306,072 | A | 4/1994 | Caldwell | 297/232 |
| 5,375,914 | A | 12/1994 | Donnelly | 297/335 |
| 5,470,128 | A | 11/1995 | Kerkham | 297/232 |
| 5,553,923 | A | 9/1996 | Bilezikjian | 297/452.2 |
| 5,658,043 | A | 8/1997 | Davidson | 297/113 |
| 5,702,157 | A | 12/1997 | Hurite | 297/411.38 |
| 5,733,010 | A | 3/1998 | Lewis et al. | 297/411.32 |
| 5,845,964 | A | 12/1998 | Phoon | 297/162 |
| 5,890,761 | A | 4/1999 | Miller | 297/232 |
| 6,019,413 | A | 2/2000 | Scraver et al. | 296/66 |
| 6,095,603 | A | 8/2000 | Hock | 297/232 |
| 6,135,562 | A | 10/2000 | Infanti | 297/440.2 |
| 6,283,550 | B1 | 9/2001 | Vialatte et al. | 297/335 |
| 6,296,315 | B1 | 10/2001 | Jensen | 297/452.14 |

OTHER PUBLICATIONS

Stadium Seating by Forum Seating; 1 page, (Undated Photo).
Eheim Waiting & Spectator Areas Brochure; ; 9 pages, (Brochure undated).
AWS Offsetdruck invoice; dated May 23, 2000; 1 page.
Lamm Drawing; June 20, 1996; 1 page.
"Modulamm Seating System" Brochure; 6 pages, (Undated).
Krueger International KI Dorsal Operational Tandem Seating Products Brochure; 7 pages; (dated 1998).
Letter received from Vedder Price P.C. (dated June 9, 2010); 3 pages.
Photos of Stadium Seat, 2 pages, undated.
SR-S16/M Seating document; 2 pages (undated document).
CATAS testing records document; 7 pages; Mar. 4, 1999.
Ministry of the Interior Fire Prevention Declaration of Conformity; issued Jul. 1997; 2 pages.
Milani Valerio Document; Sep. 16, 1998; 1 page.
Omsi Documents w/ photos; 8 pages; 1998-1999.
Charlie Stadium Seating brochure and photographs; 12 pages; (brochure undated).
Excerpts of Giancarlo Piretti documents (dated 1965); 3 pages.
Haworth DCS Axis 106-3000-4000 brochure; 11 pages; (Jul. 2009).

* cited by examiner

PEW STYLE SEATING ASSEMBLY

RELATED APPLICATIONS

This application is a continuation-in-part of and claims the benefit of U.S. patent application Ser. No. 10/991,847 filed Nov. 18, 2004, now U.S. Pat. No. 7,478,876 and is a continuation-in-part of and claims the benefit of U.S. patent application Ser. No. 10/756,743 filed Jan. 13, 2004 now U.S. Pat. No. 7,204,553.

FIELD OF THE INVENTION

The present invention relates generally to pew or bench style seating, and more particularly to a pivoting seat pew or bench style seating assembly which incorporates many benefits of theater style seating with the functionality and aesthetics of a traditional pew.

BACKGROUND OF THE INVENTION

In recent years, church congregations shopping for fixed seating have encountered a growing dilemma in reaching a consensus over the choice of pew style seating versus theater style seating. For the past decade, the number of theater seats purchased by churches has grown significantly each succeeding year. At the same time, the sentiment of many congregation members in favor of pew style seating runs as deep as the roots of church tradition.

One of the strongest appeals that has made theater style seating attractive to churches is the extra egress space achieved by the self-lifting seats. Egress space is the passage room between the rows of seats. Ample egress space provides benefits in not only audience comfort and safety, but also in contributing to ease for maintenance and cleaning purposes.

Pews that are spaced a typical 36" back-to-back may leave only about 12" of egress, which is a typical minimum fire code requirement. Theater style seating, utilizing self-lifting seats, increases this exit passage dramatically. The present invention is directed to a seating assembly that embodies all of the important features of both pew style seating and theater style seating in one assembly. The present invention maintains the traditional appearance of pews while offering the benefits of self-lifting seats. In fact, the present invention provides advantage over what is offered by either conventional pews or conventional theater seats.

The egress dimension is just one of the areas where the seating assembly of the present invention is more advantageous than traditional seating. As shown in FIGS. 11 and 12, the present invention can provide 22" or more of passageway between rows, which can be double that of conventional pews and up to 50% more than most theater seats. This extra passage, while obviously providing greater worship space and traffic flow, also offers benefits in the form of greater seat capacity, lower seating costs, and lower construction costs.

Building codes restrict the length of a conventional pew based on the egress space. A typical code may restrict pew length to between 20' to 25' where an egress of 12" is provided. As egress space increases, it becomes easier for people to maneuver between rows, and thus evacuation time will increase in the case of an emergency. Therefore, various building codes will permit additional seating and longer pews as egress space increases. Generally, an additional three seats are allowed for each one inch increase of egress. Accordingly, by increasing the available egress, the seating assembly of the present invention could be extended to more than three times the allowable length of a conventional pew, without violating code.

The seating assembly of the present invention could increase seating capacity over conventional pews. Longer rows mean that fewer aisles are required throughout the facility and fewer aisles obviously allows for more floor space to be committed to seating, producing additional seating capacity. Even if the initial cost of the seating assembly of the present invention is more than the average pew, the added product cost is far less than the added construction cost would be to expand the worship facility to accommodate the provided seating increase. Thus, the seating assembly of the present invention provides lower seating costs per person.

Moreover, aisle ways often empty into doorways. Because fewer aisles are needed with the present invention, fewer doorways are required in a construction plan, lowering overall construction costs. Similarly, the greater seating capacity eliminates the need for many intermediate steps in balcony related construction where aisles are deleted, further reducing costs.

The seating assembly of the present invention allows for the elimination of arm dividers typical to most theater seats, which arm dividers can be cumbersome. Arm dividers in conventional theater seats occupy 2 to 3 inches of seat width per seating unit, prohibit continuous seating, are a problem for larger people, and add maintenance as well as cost.

The seating assembly of the present invention may also greatly reduce the noise and maintenance often associated with self-lifting seats. The seating assembly of the present invention preferably employs a gravity lift, counter balance seat mechanism free of springs and other mechanics that generally create noise and ongoing maintenance. A preferred means of a self lifting seating assembly is disclosed in U.S. Pat. No. 6,698,834, which patent is incorporated by reference herein in its entirety. Many additional benefits of such a seating assembly are disclosed therein.

Also, traditional pews must be custom built to reach a desired or specified width. The present invention may employ modularity to its assembly components to allow it to meet any desired or specified length. The use of standardized parts and modular assembly also provides for ease in adjustments in both seating design and assembly. The modular components also allow for ease in repair and maintenance of the seating assembly.

While worship seating does not have a significant influence on worship itself, the combined physical elements of building and seat design stand to maximize stewardship goals and ministry objectives. The goal of the present invention is to partner with the architectural team in bringing these physical elements together in a way that optimizes these common objectives.

What is desired, therefore, is a pew style seating assembly which, in an unoccupied position, provides increased egress as compared to traditional pew seating assemblies and theater seating assemblies, which allows for longer rows, fewer aisles, and greater overall traffic flow as compared to traditional pew seating assemblies and theater seating assemblies, which provides greater seating capacity, offering lower seating costs and lower construction costs as compared to traditional pew seating assemblies and theater seating assemblies, and which employs modularized seating components allowing the seating assembly to be constructed to numerous desired widths without requiring customized construction or components.

SUMMARY OF THE INVENTION

Accordingly, it is an object of the present invention to provide a pew style seating assembly which, in an unoccupied position, provides increased egress as compared to traditional pew seating assemblies and theater seating assemblies.

Another object of the present invention is to provide a pew style seating assembly having the above characteristics and which allows for longer rows, fewer aisles, and greater overall traffic flow as compared to traditional pew seating assemblies and theater seating assemblies.

A further object of the present invention is to provide a pew style seating assembly having the above characteristics and which provides greater seating capacity, offering lower seating costs and lower construction costs as compared to traditional pew seating assemblies and theater seating assemblies.

Still another object of the present invention is to provide a pew style seating assembly having the above characteristics and which employs modularized seating components allowing the seating assembly to be constructed to numerous desired widths without requiring customized construction or components.

These and other objects of the present invention are achieved in accordance with one embodiment of the present invention by provision of a pew style seating assembly including a plurality of seat support members, each of which includes a downwardly extending portion terminating in a base adapted to be disposed on a floor and a forward extending portion terminating at a forward end, each pair of adjacent seat support members defining a seat space therebetween. The seating assembly also includes a plurality of seat connection mechanisms, at least one of which is attached at the forward end of the forward extending portion of each of the seat support members, and a plurality of seat members, each of which is disposed within the seat space defined between each pair of adjacent seat support members, and having two opposing sides in pivotable engagement with one of the seat connection mechanisms attached to each of the pair of adjacent seat support members. Each of the plurality of seat members is pivotable, independently from all others of the plurality of seat members, between an occupied position and an unoccupied position. A single, continuous seat back is attached to each of the seat support members and spans the seat spaces defined between the seat support members, whereby the plurality of seat members are associated with the single, continuous seat back.

In some embodiments, the plurality of seat support members comprise two end seat support members, one disposed at each end of the seating assembly, and at least one intermediate seat support member disposed between the end seat support members. In certain of these embodiments, each end seat support member comprises one seat connection mechanism facing the at least one intermediate seat support member, and each intermediate seat support member comprises two seat connection mechanisms, each of which faces a different one of the end seat support members.

In some embodiments, each of the plurality of seat connection mechanisms comprises a saddle bracket comprising an inner pivot channel, and each of the two opposing sides of the plurality of seat members comprises a pin portion comprising a pin protruding therefrom. In certain of these embodiments, when the pin portion is angled with respect to the saddle bracket at an insertion angle, the pin is insertable into and removable from the inner pivot channel, and when the pin portion is angled with respect to the saddle bracket at an angle other than the insertion angle, the pin is retained in the inner pivot channel.

In some embodiments, the seating assembly further includes an arm rest disposed at each end of the seating assembly. In some embodiments, a top surface of each of the seat members is generally planar. In some embodiments, each seat member, when in the occupied position, defines a seating area above a top surface thereof, and the seating areas defined by all of the plurality of seat members define a continuous and uninterrupted pew seating area spanning the plurality of seat members.

In accordance with another embodiment of the present invention, a pew style seating assembly includes a plurality of seat support members, each of which includes a downwardly extending portion terminating in a base adapted to be disposed on a floor and a forward extending portion terminating at a forward end, each pair of adjacent seat support members defining a seat space therebetween. The seating assembly also includes a plurality of seat connection mechanisms, at least one of which is attached at the forward end of the forward extending portion of each of the seat support members, and a plurality of seat members, each of which is disposed within the seat space defined between each pair of adjacent seat support members, and having two opposing sides in pivotable engagement with one of the seat connection mechanisms attached to each of the pair of adjacent seat support members. Each of the plurality of seat members is pivotable, independently from all others of the plurality of seat members, between an occupied position and an unoccupied position. Each seat member, when in the occupied position, defines a seating area above a top surface thereof, and the seating areas defined by the plurality of seat members define a continuous and uninterrupted pew seating area spanning the plurality of seat members.

In some embodiments, the plurality of seat support members comprise two end seat support members, one disposed at each end of the seating assembly, and at least one intermediate seat support member disposed between the end seat support members. In certain of these embodiments, each end seat support member comprises one seat connection mechanism facing the at least one intermediate seat support member, and each intermediate seat support member comprises two seat connection mechanisms, each of which faces a different one of the end seat support members.

In some embodiments, each of the plurality of seat connection mechanisms comprises a saddle bracket comprising an inner pivot channel, and each of the two opposing sides of the plurality of seat members comprises a pin portion comprising a pin protruding therefrom. In certain of these embodiments, when the pin portion is angled with respect to the saddle bracket at an insertion angle, the pin is insertable into and removable from the inner pivot channel, and when the pin portion is angled with respect to the saddle bracket at an angle other than the insertion angle, the pin is retained in the inner pivot channel.

In some embodiments, the seating assembly further includes an arm rest disposed at each end of the seating assembly. In some embodiments, the top surface of each of the seat members is generally planar. In some embodiments, the seat assembly further includes a single, continuous seat back attached to each of the seat support members and spanning the seat spaces defined between the seat support members, whereby the plurality of seat members are associated with the single, continuous seat back.

In accordance with another embodiment of the present invention, a pew style seating assembly includes a plurality of seat support members, each of which includes a downwardly extending portion terminating in a base adapted to be disposed on a floor and a forward extending portion terminating at a forward end, each pair of adjacent seat support members defining a seat space therebetween. The seating assembly also includes a plurality of seat connection mechanisms, at least one of which is attached at the forward end of the forward extending portion of each of the seat support members, and a plurality of seat members, each of which is disposed within the seat space defined between each pair of adjacent seat support members, and having two opposing sides in pivotable engagement with one of the seat connection mechanisms attached to each of the pair of adjacent seat support members. Each of the plurality of seat members is pivotable, independently from all others of the plurality of seat members, between an occupied position and an unoccupied position. Each seat member, when in the occupied position, defines a seating area above a top surface thereof, with the seating areas defined by the plurality of seat members defining a continuous and uninterrupted pew seating area spanning the plurality of seat members. The seating assembly further includes a single, continuous seat back attached to each of the seat support members and spanning the entire pew seating area, whereby the plurality of seat members are associated with the single, continuous seat back.

In some embodiments, the plurality of seat support members comprise two end seat support members, one disposed at each end of the seating assembly, and at least one intermediate seat support member disposed between the end seat support members. In certain of these embodiments, each end seat support member comprises one seat connection mechanism facing the at least one intermediate seat support member, and each intermediate seat support member comprises two seat connection mechanisms, each of which faces a different one of the end seat support members.

In some embodiments, each of the plurality of seat connection mechanisms comprises a saddle bracket comprising an inner pivot channel, and each of the two opposing sides of the plurality of seat members comprises a pin portion comprising a pin protruding therefrom. In certain of these embodiments, when the pin portion is angled with respect to the saddle bracket at an insertion angle, the pin is insertable into and removable from the inner pivot channel, and when the pin portion is angled with respect to the saddle bracket at an angle other than the insertion angle, the pin is retained in the inner pivot channel. In some embodiments, the seating assembly further includes an arm rest disposed at each end of the seating assembly. In some embodiments, the top surface of each of the seat members is generally planar.

In accordance with another embodiment of the present invention, a pew style seating assembly includes a plurality of seat members, each of which is pivotable, independently from all others of the plurality of seat members, between an occupied position and an unoccupied position. Each seat member, when in the occupied position, defines a seating area above a generally planar top surface thereof, with the seating areas defined by the plurality of seat members defining a continuous and uninterrupted pew seating area spanning the plurality of seat members. The seating assembly also includes a single, continuous seat back spanning the entire pew seating area, such that the plurality of seat members are associated with the single, continuous seat back.

The invention and its particular features and advantages will become more apparent from the following detailed description considered with reference to the accompanying drawings.

DETAILED DESCRIPTION OF AN EMBODIMENT OF THE INVENTION

Figure 1:
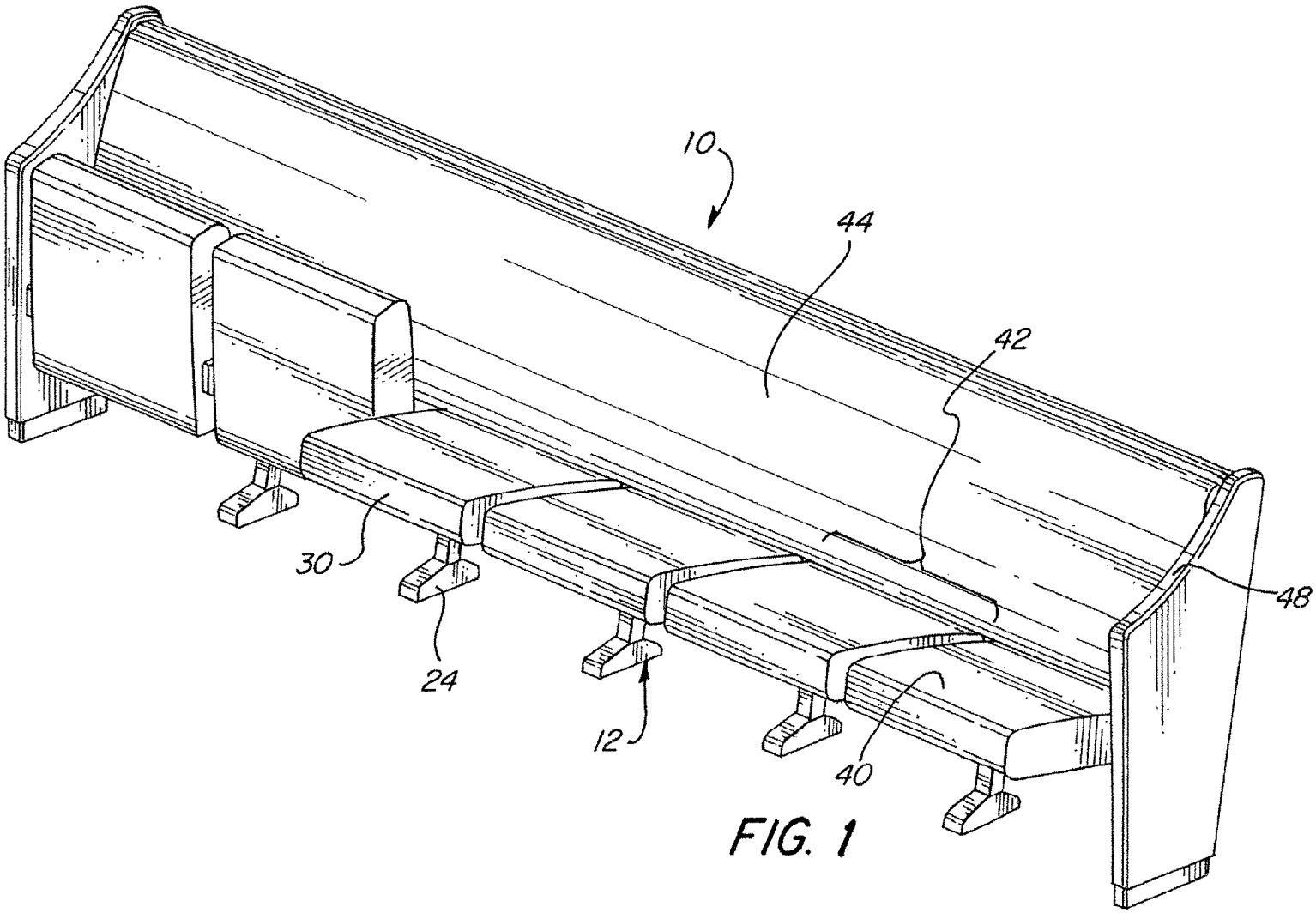
FIG. 1 is an isometric view of a pew type seating assembly in accordance with an embodiment of the present invention.
Figure 2:
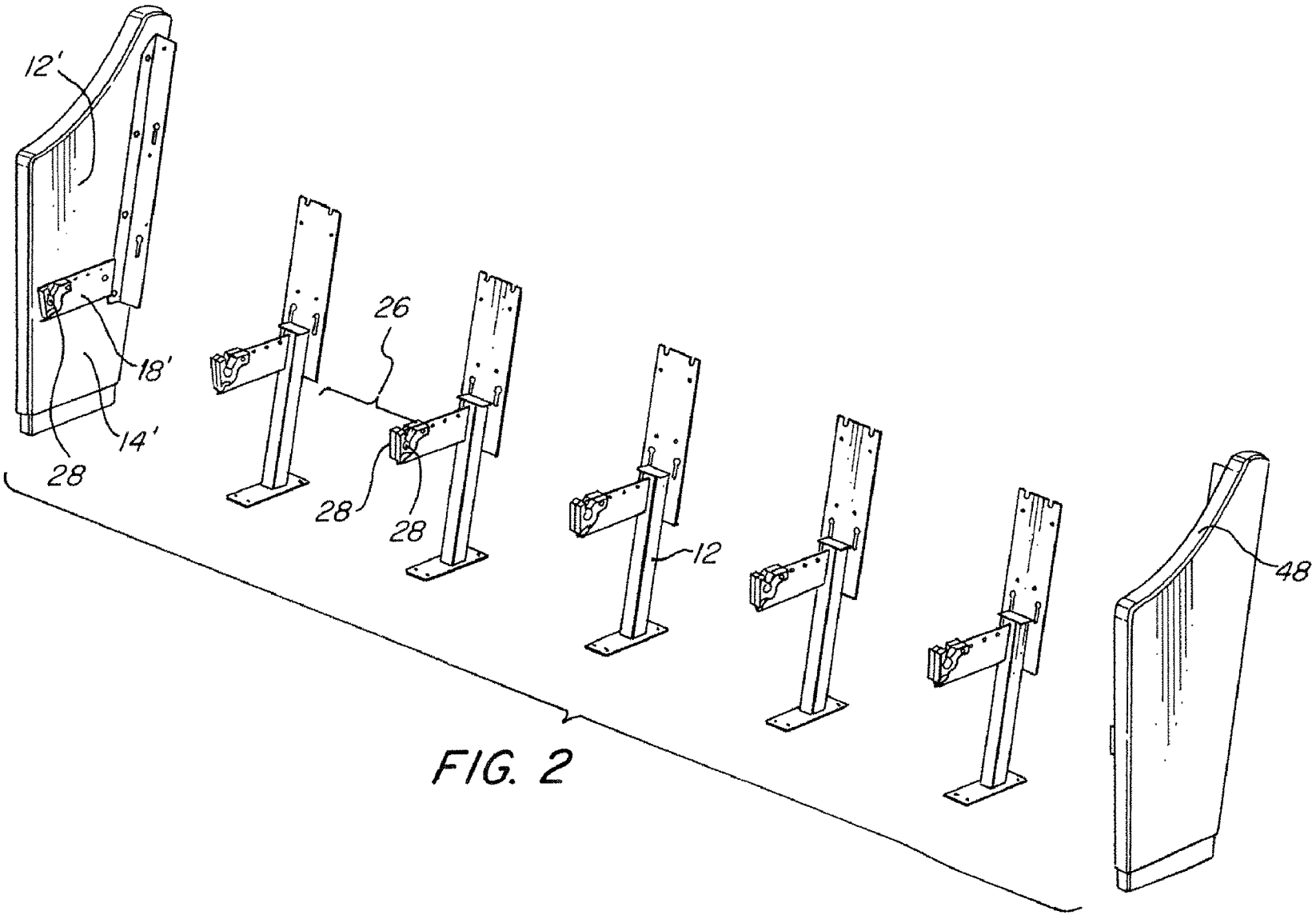
FIG. 2 is an isometric view showing portions of the pew type seating assembly of FIG. 1.
Figure 3:
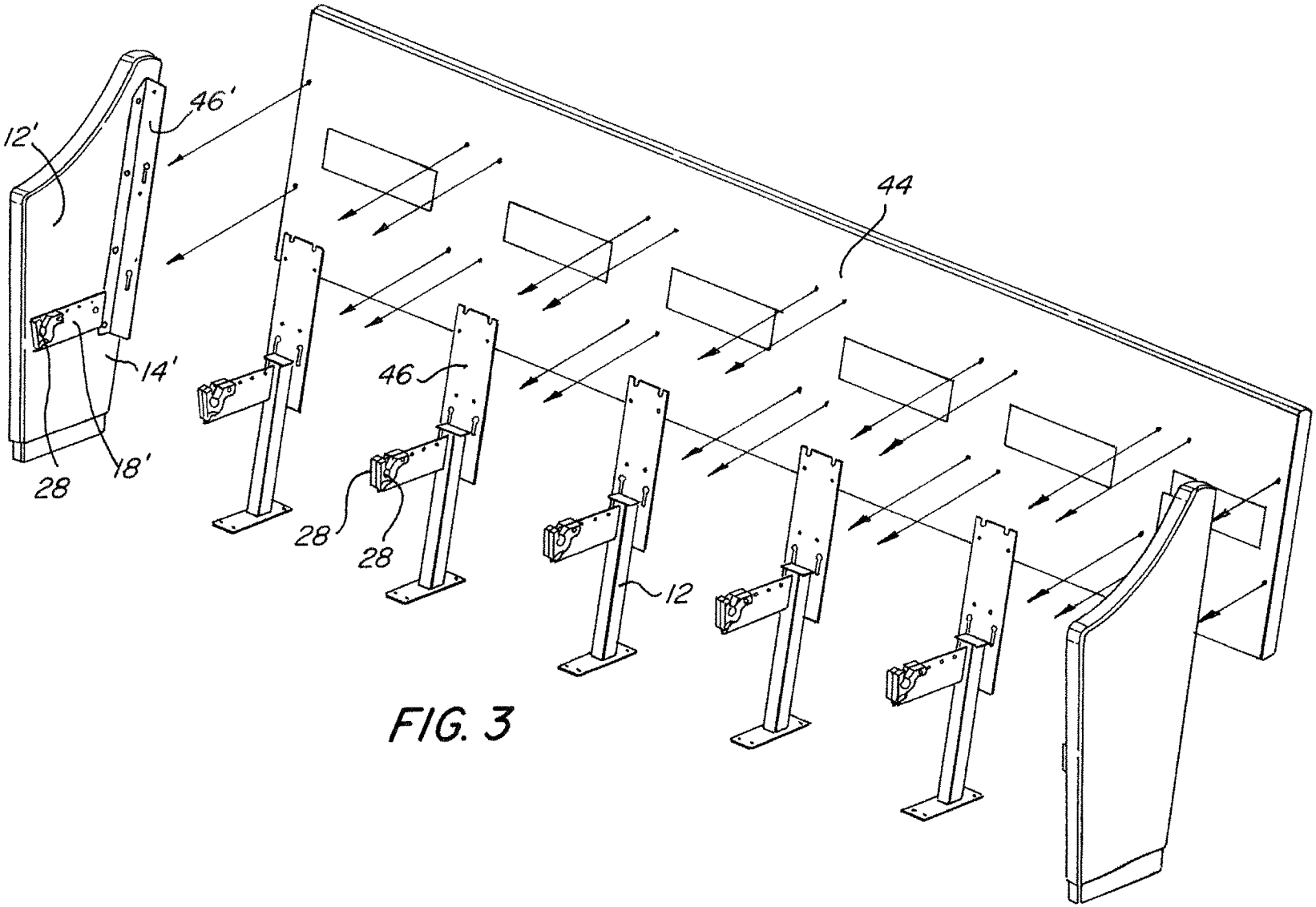
FIG. 3 is an isometric view showing portions of the pew type seating assembly of FIG. 1 as a seat back is being installed.
Figure 4:
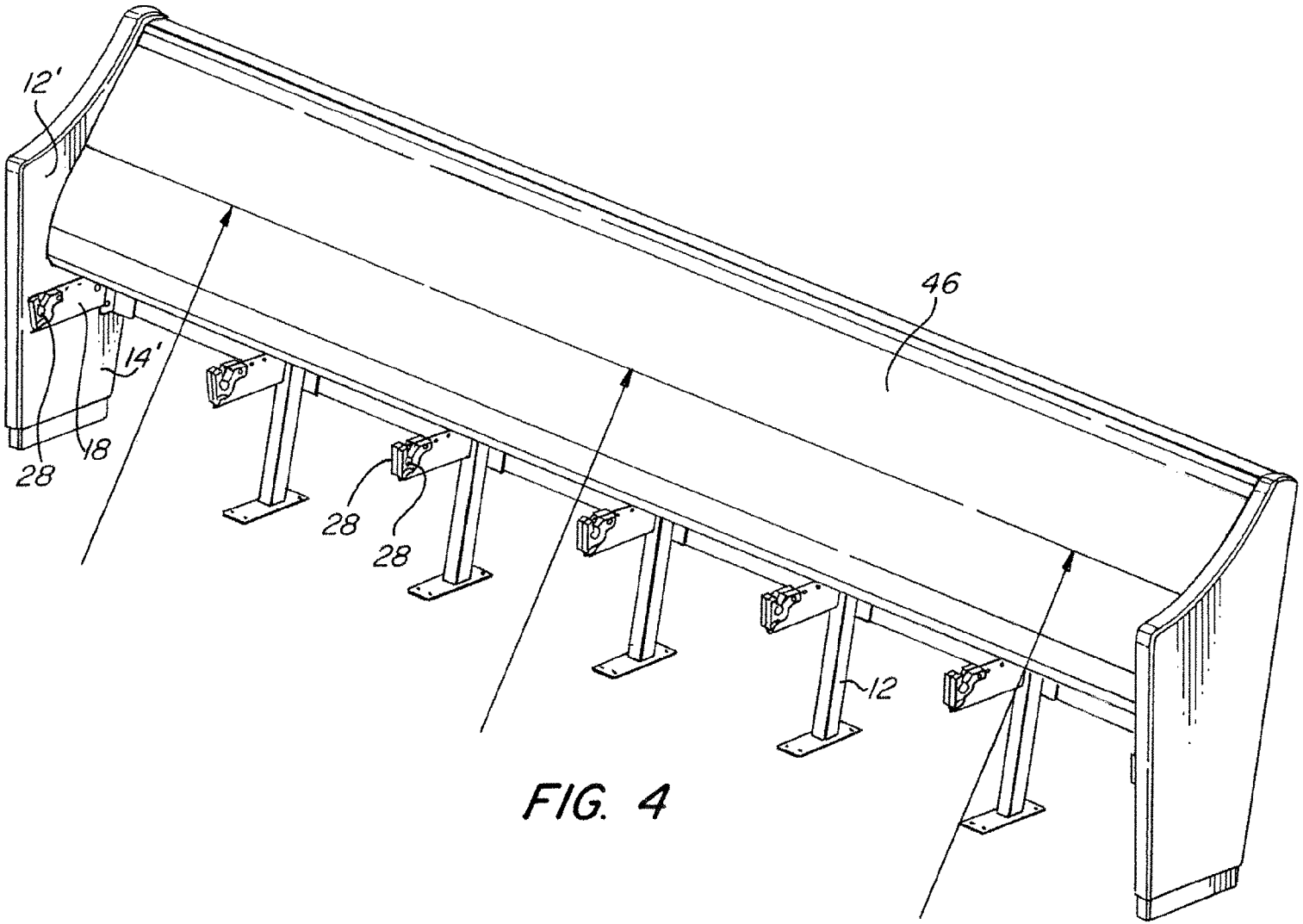
FIG. 4 is an isometric view showing portions of the pew type seating assembly of FIG. 1 as a cushion is being installed on the seat back.
Figure 5:
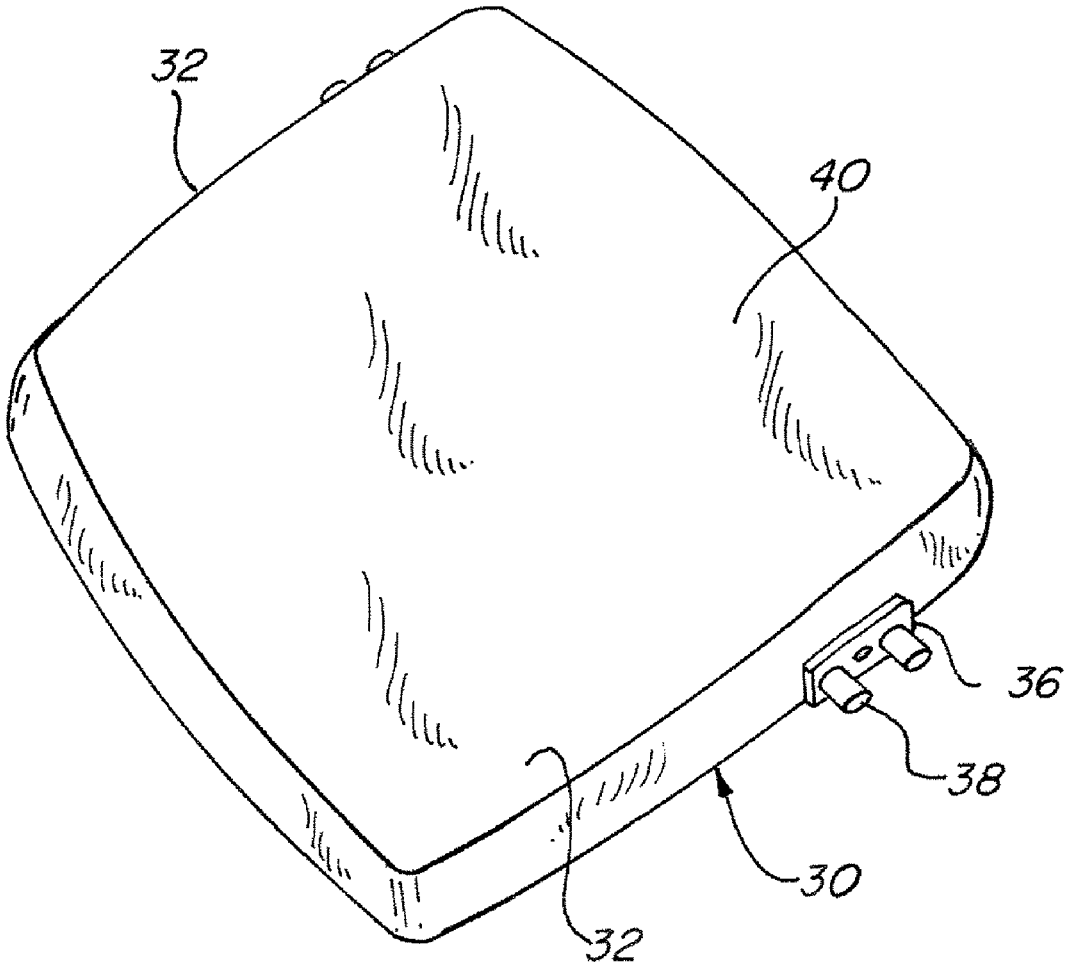
FIG. 5 is an isometric view showing a seat member portion of the pew type seating assembly of FIG. 1.
Figure 6:
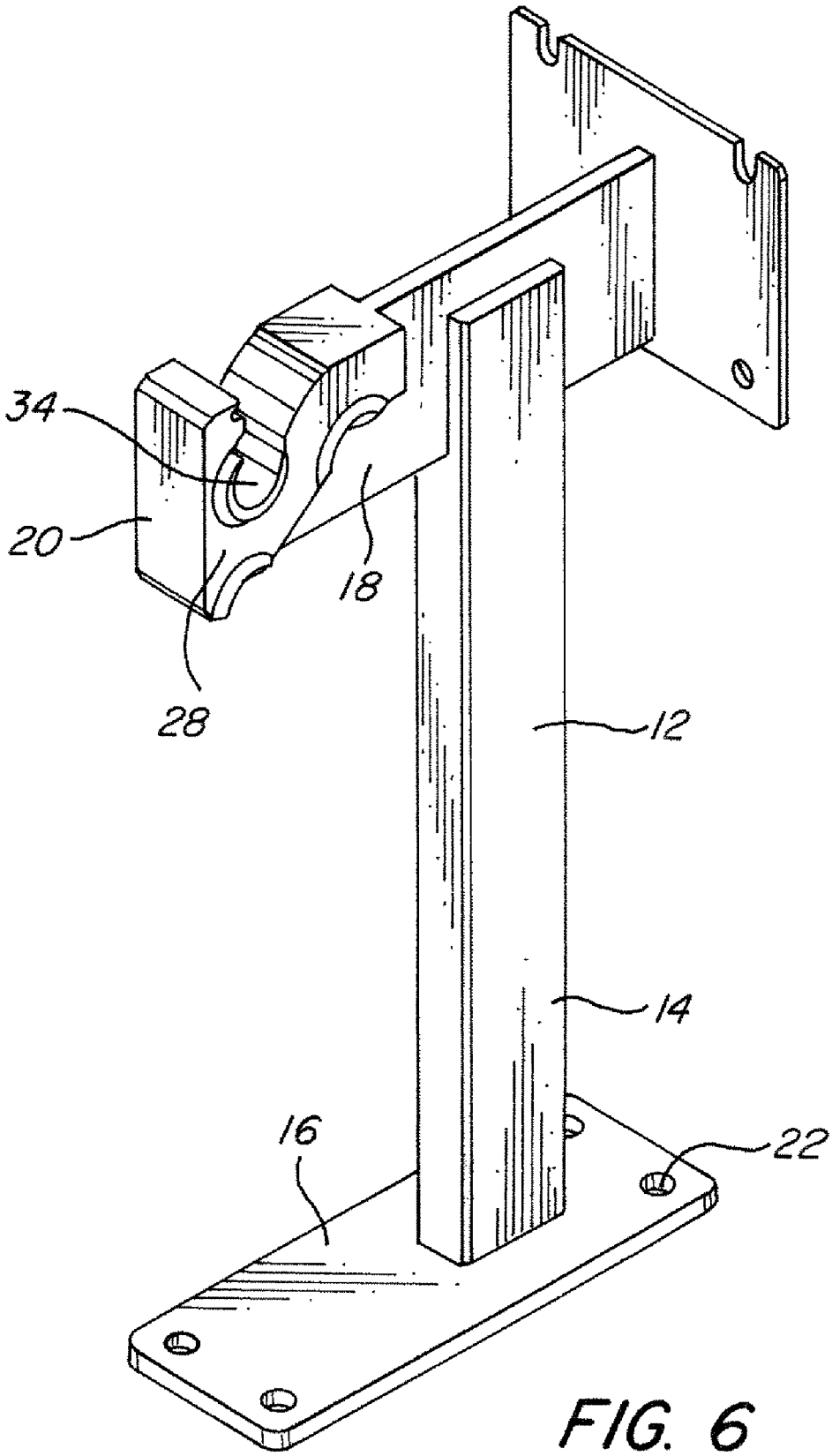
FIG. 6 is an isometric view showing a seat support member portion of the pew type seating assembly of FIG. 1.

Referring first to FIGS. 1-6, a pew style seating assembly 10 in accordance with the present invention is shown. Seating assembly 10 includes a plurality of seat support members 12, each of which includes a downwardly extending portion 14 terminating in a base 16 adapted to be disposed on a floor and a forward extending portion 18 terminating at a forward end 20. The base 16 may include holes or the like to facilitate the anchoring thereof to the floor, or the base may simply rest on the floor unattached. If desired, an aesthetically pleasing cover 24 may be provided such that base 16, and any attachment mechanisms associated therewith, are not visible. Each pair of adjacent seat support members 12 defines a seat space 26 therebetween.

Seating assembly 10 also includes a plurality of seat connection mechanisms 28, at least one of which is attached at the forward end 20 of the forward extending portion 18 of each of the seat support members 12, and a plurality of seat members 30, each of which is disposed within the seat space 26 defined between each pair of adjacent seat support members 12.

As shown in the Figures, the plurality of seat support members may comprise two end seat support members 12', one disposed at each end of the seating assembly 10, and at least one, but preferably a plurality of, intermediate seat support members 12 disposed between the end seat support members 12'. Also as can be seen in the drawings, each end seat support member 12' comprises one seat connection 28 mechanism facing the at least one intermediate seat support member 12, and each intermediate seat support member 12 comprises two seat connection mechanisms 28, each of which faces a different one of the end seat support members 12'. This is true because each end seat support member 12' only supports one seat member 30 on one side thereof (i.e., the side thereof facing an adjacent intermediate seat connection mechanism 12), while each intermediate seat support member 12 supports two seat members 30 (i.e., one on each side thereof). Also as can be seen in the drawings, end seat support members 12' may be configured differently than intermediate seat support members, typically having downwardly extending portions 14' and/or forward extending portions 18' that are more aesthetically pleasing than downwardly extending portions 14 and forward extending portions 18 of intermediate seat support members 12.

Each seat member 30 has two opposing sides 32 in pivotable engagement with one of the seat connection mechanisms 28 attached to each of a pair of adjacent seat support members 12. Each of the plurality of seat members 30 is pivotable, independently from all others of the plurality of seat members 30, between an occupied position (see the rightmost four seat members of seat assembly 10 shown in FIG. 1) and an unoccupied position (see the leftmost two seat members of seat assembly 10 shown in FIG. 1).

Each of the plurality of seat connection mechanisms 28 may comprise a saddle bracket comprising an inner pivot channel 34, and each of the two opposing sides 32 of the plurality of seat members 30 may comprise a pin portion 36 comprising a pin 38 protruding therefrom. Preferably, the seat connection mechanism 28 and the pin portion 36 are configured such that, when the pin portion 36 is angled with respect to the saddle bracket at an insertion angle, the pin 38 is insertable into and removable from the inner pivot channel 34, and when the pin portion 36 is angled with respect to the saddle bracket at an angle other than the insertion angle, the pin 38 is retained in the inner pivot channel 34. Such a configuration is described in detail in U.S. Pat. No. 6,698,834 entitled "Seat Connection Mechanism", which patent is incorporated by reference herein in its entirety, as if the disclosure thereof had been fully recited herein.

Each seat member 30, when in the occupied position, defines a seating area 42 above a top surface 40 thereof. As best seen in FIG. 1, the seating areas 42 defined by the plurality of seat members 30 define a continuous and uninterrupted pew seating area spanning the plurality of seat members 30. More specifically, the seating areas 42 defined by two adjacent seat members 30 are not interrupted by any type of impediments, such as arm rests or the like. This is completely unlike typical theater, stadium or auditorium seating, wherein the seating areas defined by two adjacent seat members are interrupted by arm rests and/or other impediments which prevent two adjacent seat members from defining one continuous and uninterrupted seating area.

Moreover, it is preferred that the top surface 40 of each of seat members 30 be generally planar, such that a generally planar and continuous seating area may be defined by two adjacent seat members 30 in the occupied position. Thus, a person sitting on seating assembly 10 may span two adjacent seat members 30 comfortably. Again, this is completely different than typical theater, stadium or auditorium seating, wherein the top surfaces of the seat members thereof are contoured such that even if two adjacent seat members were not separated by arm rests or other impediments, a person could not span two adjacent seat members comfortably.

In the embodiment shown in FIGS. 1-6, the seating assembly 10 further includes a single, continuous seat back 44 attached to each of the seat support members 12 and spanning the entire pew seating area. As such, the plurality of seat members 30 are associated with the single, continuous seat back 44, rather than each being associated with a separate seat back. Preferably, each of seat support members 12 is provided with a seat back attachment portion 46 to facilitate attachment of seat back 44. Again, the seat back attachment portion 46' of end seat support members 12' may be different in configuration than the seat back attachment portions 46 of intermediate support members 12.

Seat back 44 may include a seat back cushion 46 attachable thereto by hook and loop fasteners or the like to enhance comfort. Seat back cushion 46 may include a cover having a zipper or the like in order to allow the cover to be removed for washing, replacement, etc. Preferably, each of the end seat support members 12' includes an arm rest portion 48 disposed at each end of the seating assembly 10, to enhance comfort and to provide an aesthetically pleasing appearance along aisles between seating assemblies.

Figure 7:
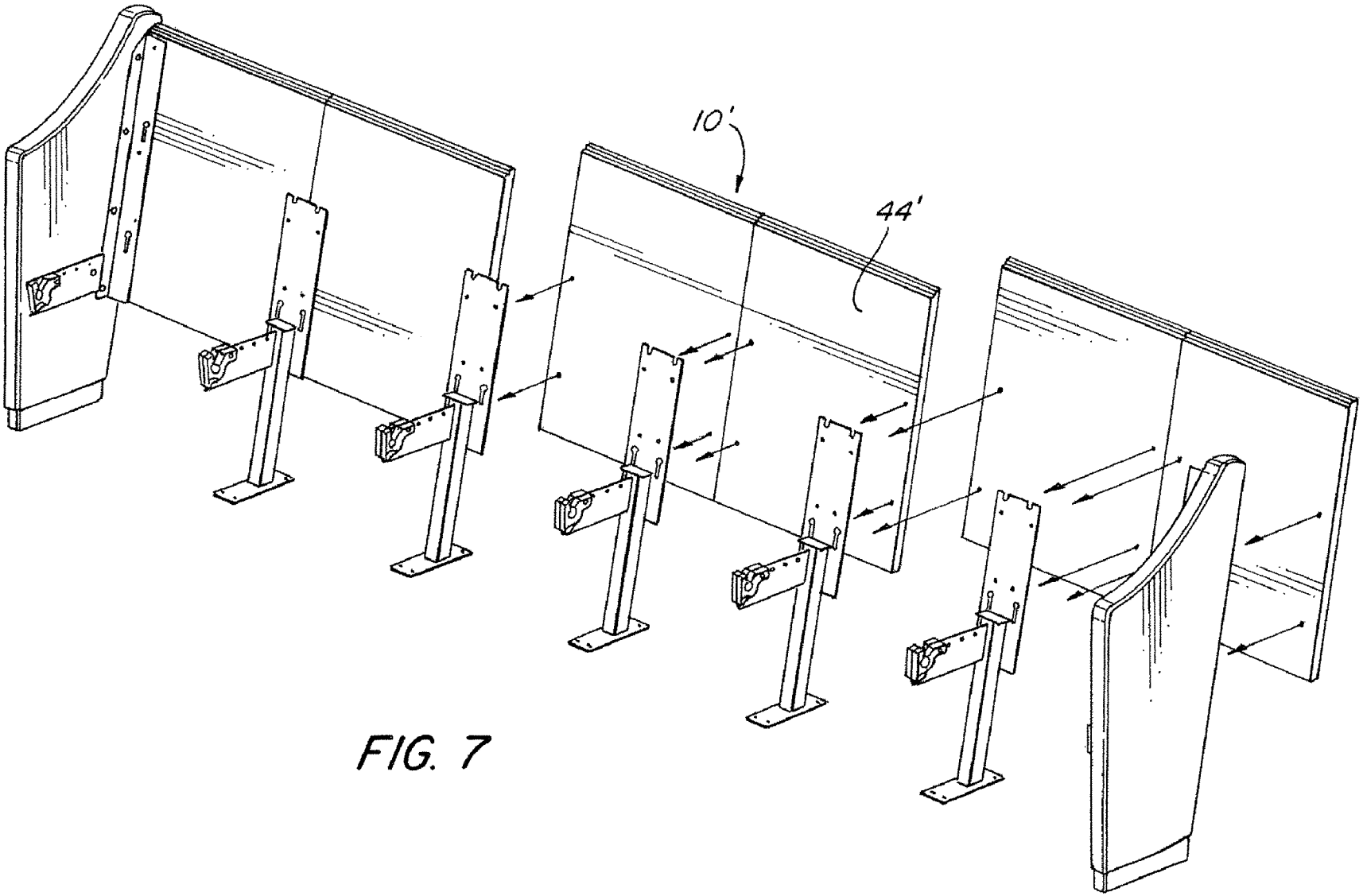
FIG. 7 is an isometric view showing portions of a pew type seating assembly in accordance with an embodiment of the present invention as a seat back is being installed.
Figure 8:
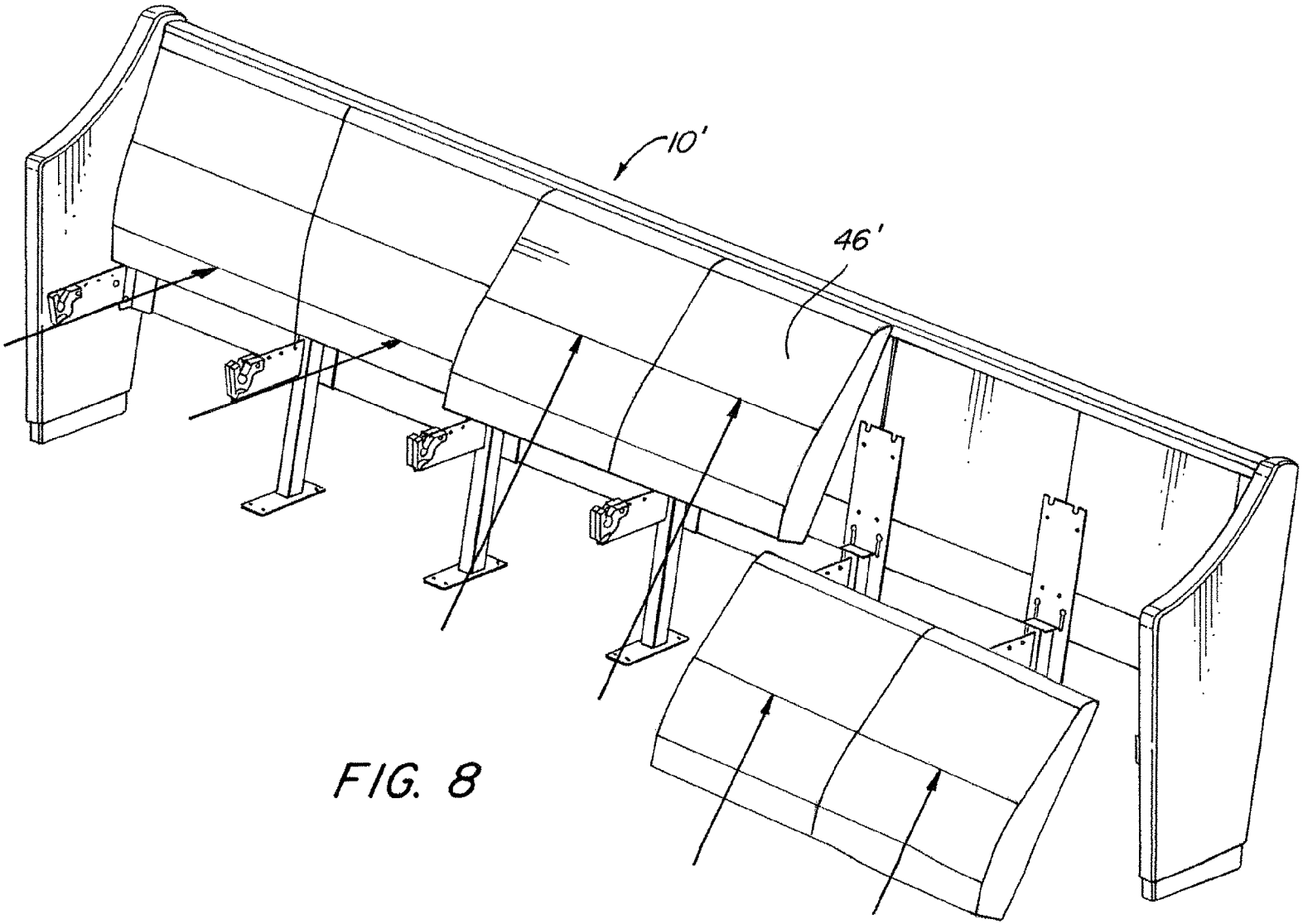
FIG. 8 is an isometric view showing portions of the pew type seating assembly of FIG. 7 as a cushion is being installed on the seat back.

Referring now to FIGS. 7 and 8, seating assembly 10' is shown. Seating assembly 10' is similar to seating assembly 10 shown in FIGS. 1-6, with the main difference being that seat back 44' does not span the entire seating assembly 10'. Instead, each seat back 44' and its corresponding seat back cushion 46' span only two seat members 30.

Figure 9:
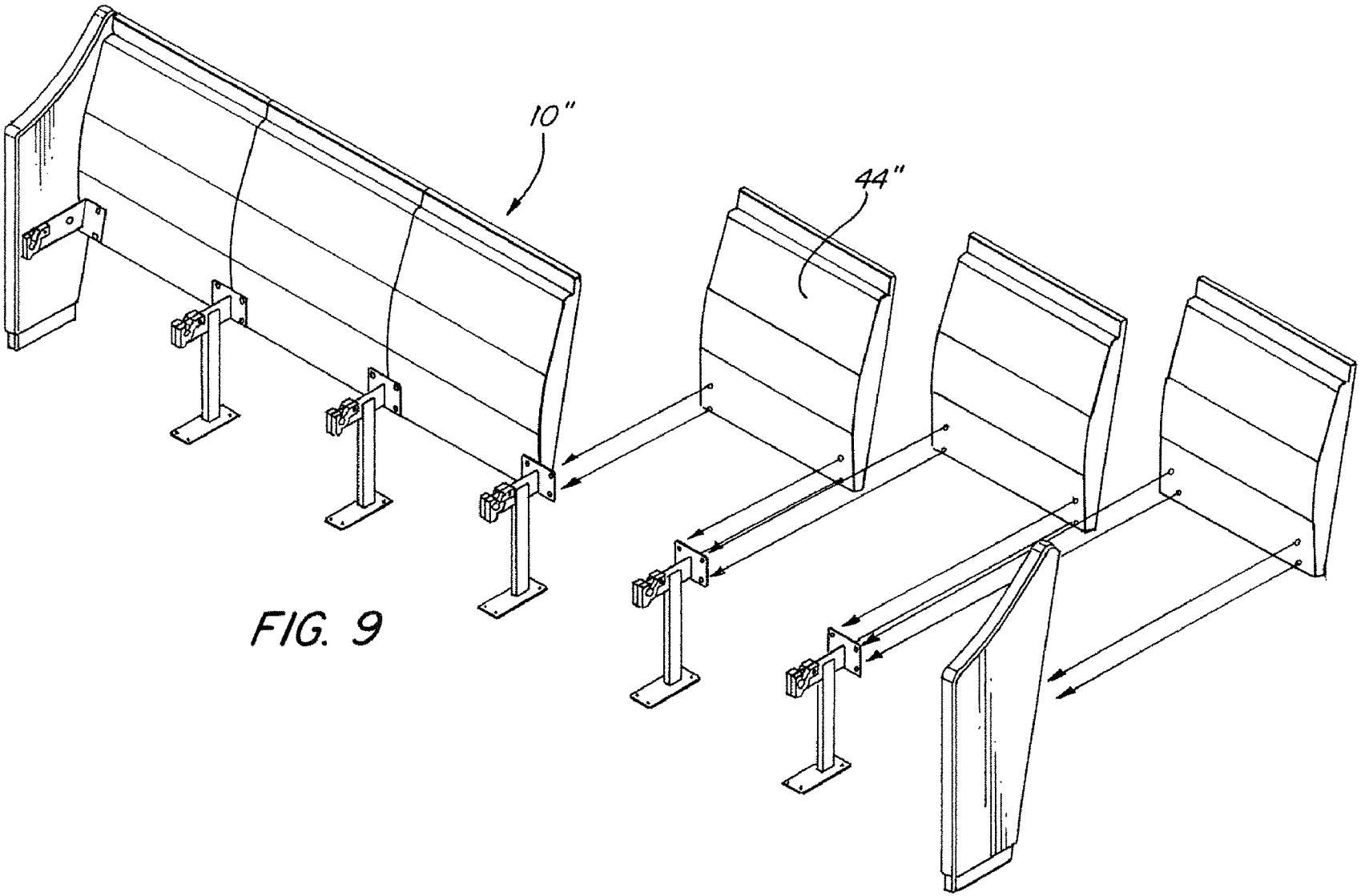
FIG. 9 is an isometric view showing portions of a pew type seating assembly in accordance with an embodiment of the present invention as a seat back is being installed.
Figure 10:
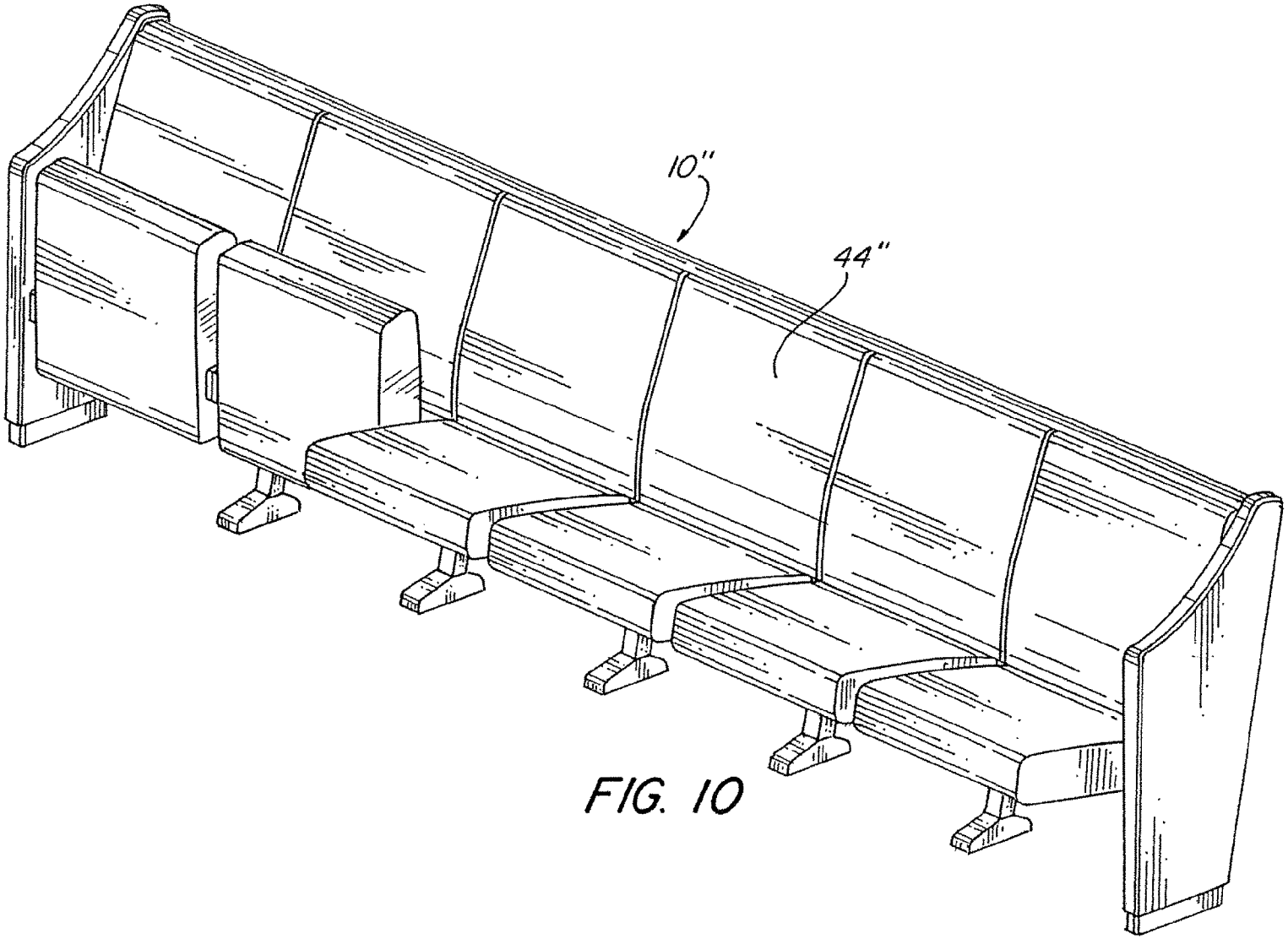
FIG. 10 is an isometric view showing the pew type seating assembly of FIG. 9 after assembly has been completed.

Referring now to FIGS. 9 and 10, seating assembly 10" is shown. Seating assembly 10" is similar to seating assembly 10 shown in FIGS. 1-6 and seating assembly 10' shown in FIGS. 7 and 8, with the main difference being that seat back 44" does not span the entire seating assembly 10" (as does seat back 44) or even a plurality of, but less than all, seat assemblies 30 (as does seat back 44'). Instead, each seat back 44" spans only one seat member 30. Another difference is that each seat back 44" is an integral unit, without a separate seat back cushion.

Figure 11:
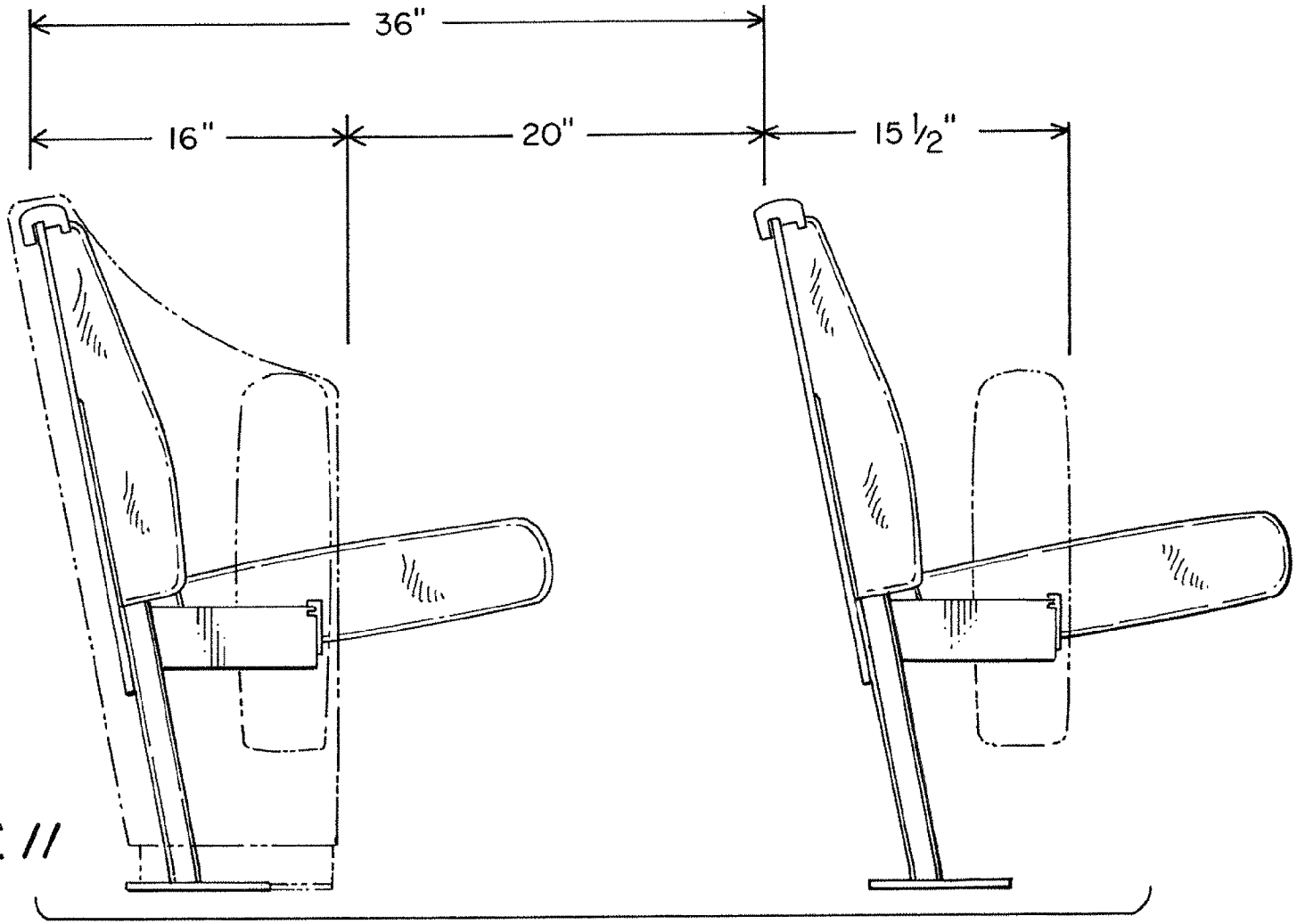
FIGS. 11 and 12 are side elevational, partially schematic views illustrating operation of pew type seating assemblies in accordance with embodiments of the present invention.
Figure 12:
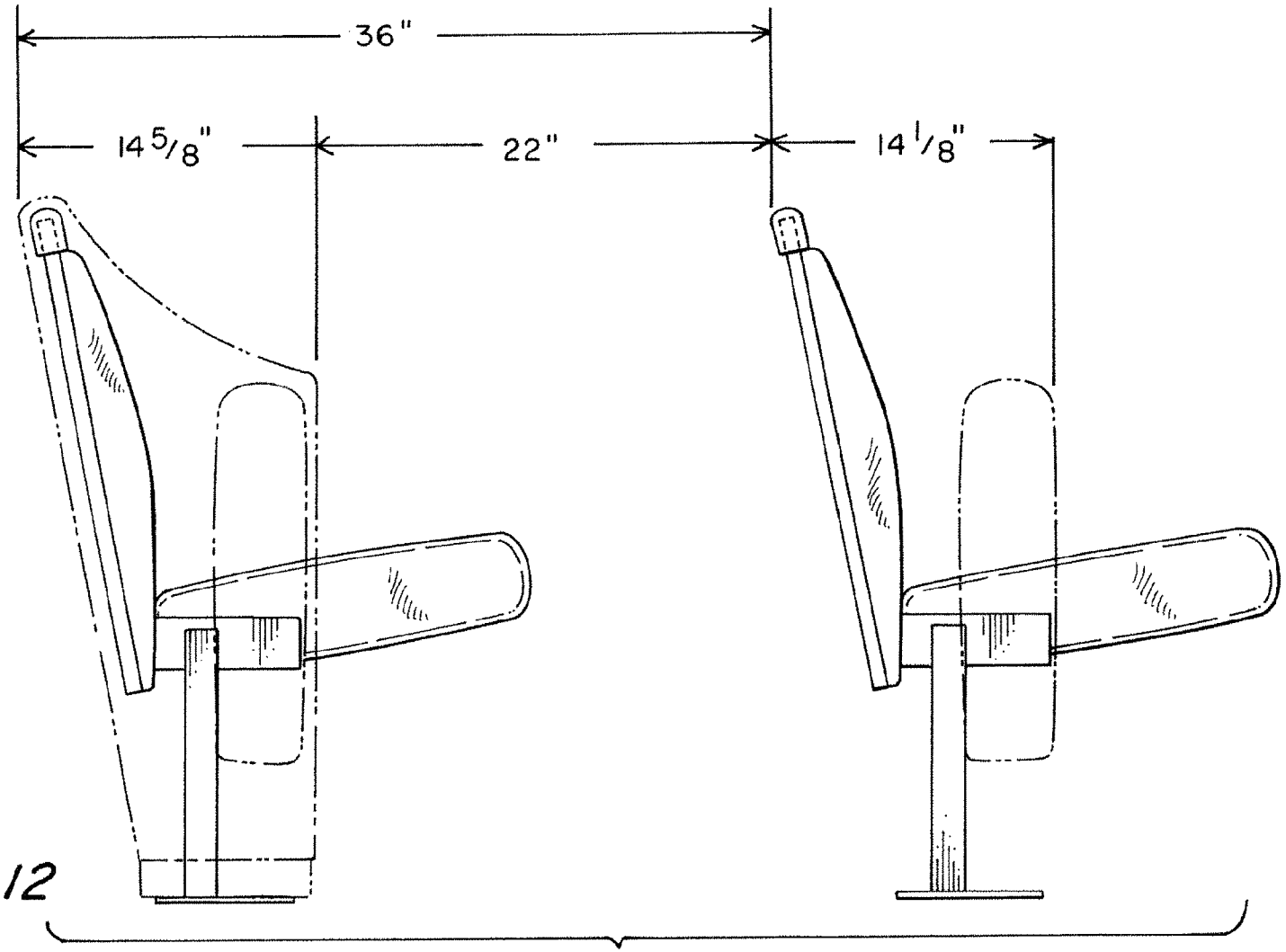

Referring now to FIGS. 11 and 12, two rows of pew style seating assemblies 10, 10', 10" are shown one behind the other. As can be seen, by providing pew style seating assemblies with seats that pivot upward into the unoccupied position when not in use, rows of seating assemblies 10, 10', 10" can be placed very close together, while still providing adequate egress. For example, in both Figures, the rows are spaced 36 inches apart, but the egress provided when the seat assemblies are in the unoccupied position is 20 inches and 22 inches, respectively. Such would not be possible with conventional pew style seating assemblies.

The present invention, therefore, provides a pew style seating assembly which, in an unoccupied position, provides increased egress as compared to traditional pew seating assemblies and theater seating assemblies, which allows for longer rows, fewer aisles, and greater overall traffic flow as compared to traditional pew seating assemblies and theater seating assemblies, which provides greater seating capacity, offering lower seating costs and lower construction costs as compared to traditional pew seating assemblies and theater seating assemblies, and which employs modularized seating components allowing the seating assembly to be constructed to numerous desired widths without requiring customized construction or components.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A pew style seating assembly comprising:

a plurality of seat support members, each of said seat support members comprising a downwardly extending portion terminating in a base adapted to be disposed on a floor and a forward extending portion terminating at a forward end, each pair of adjacent seat support members defining a seat space therebetween;

a plurality of seat connection mechanisms, at least one seat connection mechanism being attached at the forward end of the forward extending portion of each of said seat support members;

a plurality of seat members, each of said seat members being disposed within the seat space defined between each pair of adjacent seat support members, and having two opposing sides in pivotable engagement with one of said seat connection mechanisms attached to each of the pair of adjacent seat support members, each of said plurality of seat members being pivotable, independently from all others of said plurality of seat members, between an occupied position and an unoccupied position; and a single, continuous seat back attached to each of said seat support members and spanning the seat spaces defined between said seat support members, whereby said plurality of seat members are associated with said single, continuous seat back.

2. The seating assembly of claim 1 wherein said plurality of seat support members comprise two end seat support members, one disposed at each end of said seating assembly, and at least one intermediate seat support member disposed between the end seat support members.

3. The seat assembly of claim 2 wherein each end seat support member comprises one seat connection mechanism facing the at least one intermediate seat support member, and wherein each intermediate seat support member comprises two seat connection mechanisms, each of which faces a different one of the end seat support members.

4. The seat assembly of claim 1 wherein each of said plurality of seat connection mechanisms comprises a saddle bracket comprising an inner pivot channel, and wherein each of the two opposing sides of said plurality of seat members comprises a pin portion comprising a pin protruding therefrom.

5. The seat assembly of claim 4 wherein, when said pin portion is angled with respect to said saddle bracket at an insertion angle, the pin is insertable into and removable from the inner pivot channel, and when said pin portion is angled with respect to said saddle bracket at an angle other than the insertion angle, the pin is retained in the inner pivot channel.

6. The seat assembly of claim 1 further comprising an arm rest disposed at each end of said seating assembly.

7. The seat assembly of claim 1 wherein a top surface of each of said seat members is generally planar.

8. The seat assembly of claim 1 wherein each seat member, when in the occupied position, defines a seating area above a top surface thereof, and wherein the seating areas defined by all of said plurality of seat members defining a continuous and uninterrupted pew seating area spanning said plurality of seat members.

9. A pew style seating assembly comprising:

a plurality of seat support members, each of said seat support members comprising a downwardly extending portion terminating in a base adapted to be disposed on a floor and a forward extending portion terminating at a forward end, each pair of adjacent seat support members defining a seat space therebetween;

a plurality of seat connection mechanisms, at least one seat connection mechanism being attached at the forward end of the forward extending portion of each of said seat support members;

a plurality of seat members, each of said seat members being disposed within the seat space defined between each pair of adjacent seat support members, and having two opposing sides in pivotable engagement with one of said seat connection mechanisms attached to each of the pair of adjacent seat support members, each of said plurality of seat members being pivotable, independently from all others of said plurality of seat members, between an occupied position and an unoccupied position;

wherein each seat member, when in the occupied position, defines a seating area above a top surface thereof, and wherein the seating areas defined by said plurality of seat members defining a continuous and uninterrupted pew seating area spanning said plurality of seat members; and wherein each of said plurality of seat connection mechanisms comprises a saddle bracket comprising an inner pivot channel, and wherein each of the two opposing sides of said plurality of seat members comprises a pin portion comprising a pin protruding therefrom.

10. The seating assembly of claim 9 wherein said plurality of seat support members comprise two end seat support members, one disposed at each end of said seating assembly, and at least one intermediate seat support member disposed between the end seat support members.

11. The seat assembly of claim 10 wherein each end seat support member comprises one seat connection mechanism facing the at least one intermediate seat support member, and wherein each intermediate seat support member comprises two seat connection mechanisms, each of which faces a different one of the end seat support members.

12. The seat assembly of claim 9 wherein the top surface of each of said seat members is generally planar.

13. The seat assembly of claim 9 wherein, when said pin portion is angled with respect to said saddle bracket at an insertion angle, the pin is insertable into and removable from the inner pivot channel, and when said pin portion is angled with respect to said saddle bracket at an angle other than the insertion angle, the pin is retained in the inner pivot channel.

14. The seat assembly of claim 9 further comprising an arm rest disposed at each end of said seating assembly.

15. A pew style seating assembly comprising:

a plurality of seat support members, each of said seat support members comprising a downwardly extending portion terminating in a base adapted to be disposed on a floor and a forward extending portion terminating at a forward end, each pair of adjacent seat support members defining a seat space therebetween;

a plurality of seat connection mechanisms, at least one seat connection mechanism being attached at the forward end of the forward extending portion of each of said seat support members;

a plurality of seat members, each of said seat members being disposed within the seat space defined between each pair of adjacent seat support members, and having two opposing sides in pivotable engagement with one of said seat connection mechanisms attached to each of the pair of adjacent seat support members, each of said plurality of seat members being pivotable, independently from all others of said plurality of seat members, between an occupied position and an unoccupied position;

wherein each seat member, when in the occupied position, defines a seating area above a top surface thereof, and wherein the seating areas defined by said plurality of seat members defining a continuous and uninterrupted pew seating area spanning said plurality of seat members; and a single, continuous seat back attached to each of said seat support members and spanning the seat spaces defined between said seat support members, whereby said plurality of seat members are associated with said single, continuous seat back.

16. A pew style seating assembly comprising:

a plurality of seat support members, each of said seat support members comprising a downwardly extending portion terminating in a base adapted to be disposed on a floor and a forward extending portion terminating at a forward end, each pair of adjacent seat support members defining a seat space therebetween;

a plurality of seat connection mechanisms, at least one seat connection mechanism being attached at the forward end of the forward extending portion of each of said seat support members;

a plurality of seat members, each of said seat members being disposed within the seat space defined between each pair of adjacent seat support members, and having two opposing sides in pivotable engagement with one of said seat connection mechanisms attached to each of the pair of adjacent seat support members, each of said plurality of seat members being pivotable, independently from all others of said plurality of seat members, between an occupied position and an unoccupied position;

wherein each seat member, when in the occupied position, defines a seating area above a top surface thereof, and wherein the seating areas defined by said plurality of seat members defining a continuous and uninterrupted pew seating area spanning said plurality of seat members; and a single, continuous seat back attached to each of said seat support members and spanning the entire pew seating area, whereby said plurality of seat members are associated with said single, continuous seat back.

17. The seat assembly of claim 16 wherein the top surface of each of said seat members is generally planar.

18. The seating assembly of claim 16 wherein said plurality of seat support members comprise two end seat support members, one disposed at each end of said seating assembly, and at least one intermediate seat support member disposed between the end seat support members.

19. The seat assembly of claim 18 wherein each end seat support member comprises one seat connection mechanism facing the at least one intermediate seat support member, and wherein each intermediate seat support member comprises two seat connection mechanisms, each of which faces a different one of the end seat support members.

20. The seat assembly of claim 16 wherein each of said plurality of seat connection mechanisms comprises a saddle bracket comprising an inner pivot channel, and wherein each of the two opposing sides of said plurality of seat members comprises a pin portion comprising a pin protruding therefrom.

21. The seat assembly of claim 20 wherein, when said pin portion is angled with respect to said saddle bracket at an insertion angle, the pin is insertable into and removable from the inner pivot channel, and when said pin portion is angled with respect to said saddle bracket at an angle other than the insertion angle, the pin is retained in the inner pivot channel.

22. The seat assembly of claim 16 further comprising an arm rest disposed at each end of said seating assembly.

* * * * *